US005591060A

United States Patent [19]

Forsyth

[11] Patent Number: 5,591,060

[45] Date of Patent: Jan. 7, 1997

[54] RETENTION ASSEMBLY

[76] Inventor: Michael Forsyth, 1/15 Marine Parade, Manly NSW 2095, Australia

[21] Appl. No.: 256,229

[22] PCT Filed: Dec. 31, 1992

[86] PCT No.: PCT/AU92/00688

§ 371 Date: Jun. 29, 1994

§ 102(e) Date: Jun. 29, 1994

[87] PCT Pub. No.: WO93/12969

PCT Pub. Date: Jul. 8, 1993

[30] Foreign Application Priority Data

Dec. 31, 1991 [AU] Australia ..... PL00200

[51] Int. Cl.[6] ..... A63C 15/00

[52] U.S. Cl. ..... 441/75

[58] Field of Search ..... 441/74, 70, 75; 114/39.2

[56] References Cited

U.S. PATENT DOCUMENTS

| | | | |
|---|---|---|---|
| 4,592,734 | 6/1986 | Metiver | 114/39.2 |
| 4,624,646 | 11/1986 | Strohmeier | 441/70 |
| 4,645,466 | 2/1987 | Ellis | 441/74 |
| 4,960,063 | 10/1990 | Bontemps | 441/75 |
| 5,167,553 | 12/1992 | Wilson | 441/75 |

FOREIGN PATENT DOCUMENTS

| | | | |
|---|---|---|---|
| 125226 | 8/1947 | Australia . | |
| 407911 | 7/1967 | Australia . | |
| 402312 | 7/1967 | Australia . | |
| 47747 | 12/1979 | Australia . | |
| 1205988 | 8/1988 | Australia . | |
| 24042 | 9/1989 | Australia . | |
| 346509 | 12/1989 | European Pat. Off. | 441/75 |
| 2125680 | 3/1984 | United Kingdom . | |

*Primary Examiner*—Stephen Avila

*Attorney, Agent, or Firm*—Michael D. Bednarek; Kilpatrick & Cody

[57] ABSTRACT

Foot retainer (11) has a pair of flexible PVC straps (14) and (15) joined at their upper ends to form headpiece (19). Batten (21) is connected to headpiece (19) and base (26). Headpiece (19) rotates between a prone position and an upstanding position. The retention assembly is biased to its upstanding position by an elasticized tensioner (22). The base (26) is bonded to the back face of a velcro-like surface for attachment to a surfboard. In an upstanding attitude batten (21) is inclined upwardly at an acute angle to base (26) to form a jaw into which straps (14) and (15) can move under the sideways action of a rider's foot. This action against straps (14) and (15) causes headpiece (19) to pivot and move downward to partially envelop the upper area of the foot which is thus retained by the assembly.

17 Claims, 6 Drawing Sheets

RETENTION ASSEMBLY

TECHNICAL FIELD

This invention relates to a retention assembly.

The invention has particular but not exclusive application to a retention assembly for retaining a user's foot in contact with a supporting surface. The invention is particularly suitable for maintaining foot contact between a rider and a surfboard or the like and for illustrative purposes reference will be made herein to such an application. However it will be understood that the retention means is also suitable for use with sailboards on land, sea or ice, with towed or propelled skis, and with bodyboards, snowboards, skateboards, kneeboards and the like.

Furthermore, the invention is not limited to recreational use as described above. The invention can be used in other applications where it is desired that a user's foot be securely retained. Foe example, the invention can establish secure foot holds when climbing.

BACKGROUND ART

The art of surfboard riding is rapidly changing as the skills and manoeuvres developed in windsurfing on sailboards are adopted for surfboards. However unlike windsurfing where control of the sailboard is maintained by the rider's hands in holding the sail as well as by the position of and pressure exerted by the rider's feet on the board, in boardsurfing the only control of the surfboard is via the feet. It is therefore desirable that foot contact with the board be maintained.

Surfboard riders now practice routines in which the surfboard loses contact with the water. Typical of such manoeuvres is the so-called "aerial" when the rider and board run along and then up the face of a wave and become airborne as the board progresses over the lip of the wave, and a "floater" when the rider drops down a wave from the lip to the base through the air or cushioned only by aerated foam. It is particularly desirable both for high performance and safety that foot contact be maintained with the surfboard during such manoeuvres. During aerial manoeuvres it is known for surfboard riders to hold the board as skateboard riders do, but this means that the arms are not free for balancing.

A number of arrangements are known whereby contact between a surfboard rider's foot and the surfboard is maintained or facilitated in an attempt to enhance control.

In one known arrangement disclosed in Australian Patent 601941 to Burrows and Reimers, a fixed post or "rocket block" is located adjacent the tail of the surfboard so that a rider's foot abuts against the block. Some such blocks are slightly concave so that a rider's heel and sidefoot can adopt a number of positions. Such a device has a number of disadvantages. Positive contact with the foot is not maintained during aerial manoeuvres; it is fixed to the board and not adaptable for easy relocation; being fixed and upstanding, it can cause scratching and grazing to a rider's leg which is dragged across the tail block during the action of standing up on the board from a lying position. Furthermore, if located in the forward area of the board such rocket blocks impede the rapid and frequent foot movements necessary for control and also hinder a rider lying prone on a board when swimming.

Another arrangement is disclosed in Australian patent application 16137/92 to Sunbum Pty Limited. This application relates to a foot strap for a sailboard which is fixedly attached to the board. Such footstraps maintain the foot in contact with the relatively heavy sailboard by looping over the foot which is jammed in between the board and the underside of the foot strap. Attempts have been made to utilise such sailboard footstraps on surfboards to enhance control during aerial manoeuvreing on the surfboard. However the straps have certain disadvantages. In particular they prevent the heel to toe transitions essential for fine control in high performance competitive surfboarding. Moreover the straps can be dangerous if the rider's foot becomes caught in the strap during a fall from the surfboard.

Australian patent application 21600/88 to Look S.A. discloses a foot strap assembly having a release mechanism operable in response to pressure in one direction but inoperable in response to pressure in a transverse direction. Such an assembly is relatively expensive and addresses only the safety problems of fixed footstraps referred to above. The footstrap disclosed in 21600/88 does not permit heel to toe transitions for controlling a surfboard. Furthermore, footstraps impede free and unrestricted foot movement across the board and therefore can result in difficulty in hurriedly placing the foot in the footstrap in anticipation of performing a particular manoeuvre.

It has also been proposed that a rider wear a shoe having a velcro-like surface on the sole. As used herein the terms "velcro" or "velcro-like" refer to post and hook style releasably permanent fasteners. Other velcro-like surfaces are located on the board surface in suitable locations and when the rider's velcro booted foot is placed on the velcro covered portion of the board, the rider's foot is firmly retained. However velcro soled boots fix the feet in the position relatively firmly and are not easily removed by the rider to another position. Furthermore this relatively permanent fix, being suitable for only one manoeuvre, can create a tendency for riders to concentrate particularly on foot placement and can impair overall performance.

It is known to provide skateboards with a fixed forward post having a flange under which the rider's foot can engage to retain the skate to the foot when airborne and use of such a footstop on a surfboard has been contemplated. However such an arrangement has the same disadvantages discussed above with the footstrap. Moreover, much of a surfboard rider's time in the water is spent paddling out and lying in a prone position on the board. Accordingly it is desirable that any foot restraining arrangements be substantially flat during this activity.

DISCLOSURE OF THE INVENTION

The present invention aims to provide a retention assembly which will be reliable and efficient in use.

This invention in one aspect resides broadly in a retention assembly for retaining a user's foot in contact with a support surface, the retention assembly including foot engagement means having a lower portion adapted for flexible attachment relative to the support surface for engagement by a user's foot, a distal upper portion adapted to move over a user's foot when force is applied to the lower portion by the user's foot, and holding means for holding the distal upper portion in an upstanding attitude.

The retaining action may be effected by downward movement of a user's foot on a lower portion adapted to be engaged by the underside of a user's foot and in such an arrangement this action may cause the upper portion to pivot relative to the support surface to move over the foot. However it is preferred that the foot engagement means is adapted to abut the upper areas of a user's foot when a substantially lateral force is applied to the lower portion by the user's foot. Preferably the lateral force is applied by sideways movement of the outer side of the rider's foot.

The lower portion may comprise a substantially sheet like surface adapted for attachment relative to the support surface. However preferably the lower portion includes a plurality of flexible strap-like members adapted for spaced attachment relative to the support surface, the distal ends of the strap-like members being interconnected and constituting the upper portion.

The holding means may be constituted by suitable pre-stressing of the foot engagement means to rigidly brace the upper portion for pivotal movement relative to the support surface. This can be achieved by utilising a resilient material and forming the foot engagement means to be substantially cup shaped. Whilst being collapsible under the action of forces applied in one lateral direction, the arrangement is rigidly braced against collapsing under the action of forces applied in the opposite direction. However preferably the holding means includes bracing means for rigidly bracing the upper portion for pivotal movement relative to the support surface.

In use the assembly can adopt a prone attitude in which the assembly is substantially flattened against the surface of the support surface or the upstanding attitude in which the foot engagement means projects above the surface.

Suitably the bracing means is a strut-like member attached to the upper portion and pivotally attached to the assembly at a location distant the attachments of the strap-like members such that in the upstanding attitude the strut-like member is inclined upwardly at an acute angle to the support surface to form a jaw into which the strap-like members can move under the action of a user's foot thereagainst to pull the upper portion of the foot engagement means in the direction of the foot.

The strut-like member can be constructed with an in-built bias such as by pre-stressing a plastic material having memory such that when the strut-like member is affixed relative to the support surface and is attached to the upper portion, the foot engagement means will adopt the upstanding attitude. However it is preferred that the retention assembly includes biasing means adapted to bias the assembly from the prone attitude to the upstanding attitude.

The biasing means may be a compression spring positioned between the support surface and the strut-like member. However preferably the biasing means includes an elastic member connectable to the upper portion and releasably fixable relative to the support surface.

The foot engagement means, the strut-like member and the biasing means can be directly connected to the support surface. However it is preferred that the retention assembly includes attachment means adapted for releasable fixed attachment relative to the support surface.

Suitably the attachment means includes at least one releasable engagement means supporting the foot engagement means and releasably engageable by another releasable engagement means fixedly attached to the support surface. The releasable engagement means may be a mechanically acting clasp or the like but it is preferred that the releasable engagement means comprises velcro-like gripping surfaces, and that the foot engagement means and the bracing means are respectively flexibly and pivotally affixed relative to at least one velcro-like gripping surface.

The components of the retention assembly may be affixed directly to the velcro-like gripping surface, but preferably the retention assembly includes a base support fixedly attached to the velcro-like gripping surface. The base support and the foot engagement means can be a flexible PVC or similar material, the strut-like member can be a hard PVC or similar material, and the foot engagement means and the strut-like member can be attached to the base support by stitching and/or bonding. The bonding can be performed by heat or sonic welding, by chemical or adhesive bonding or by other suitable methods.

In another aspect this invention resides broadly in a collapsible foot retention assembly including:

a collapsible member adapted to extend upwardly from a support surface and forming a jaw therewith adapted to receive and retain with a user's foot, and holding means for holding the collapsible member in an upstanding attitude.

In a preferred embodiment the holding means includes a strut-like member and biasing means adapted to bias the collapsible member to the upstanding attitude. The collapsible member may include a plurality of flexible strap-like members adapted for spaced attachment relative to the support surface, the distal ends of the strap-like members being interconnected. Preferably the strut-like member is attached to the interconnected distal ends and pivotally attached to the assembly at a location distant the attachments of the strap-like members. It is preferred that the retention assembly includes a base support fixedly attached to a velcro-like gripping surface.

In yet another aspect this invention resides broadly in a method of retaining a user's foot in contact with a surfboard or the like, the method including:

locating at least one retention assembly as defined above on the surfboard or the like, and pushing a foot against the lower portion of the foot engagement means to apply a substantially lateral force thereto.

In a further aspect this invention resides broadly in a surfboard or like assembly including:

a surfboard or the like; at least one releasable engagement means affixed thereto; and at least one retention assembly as defined above and adapted for releasable engagement with the releasable engagement means.

DESCRIPTION OF PREFERRED EMBODIMENT

In order that this invention may be more easily understood and put into practical effect, reference will now be made to the accompanying drawings which illustrate a preferred embodiment of the invention, wherein.

Figure 1:
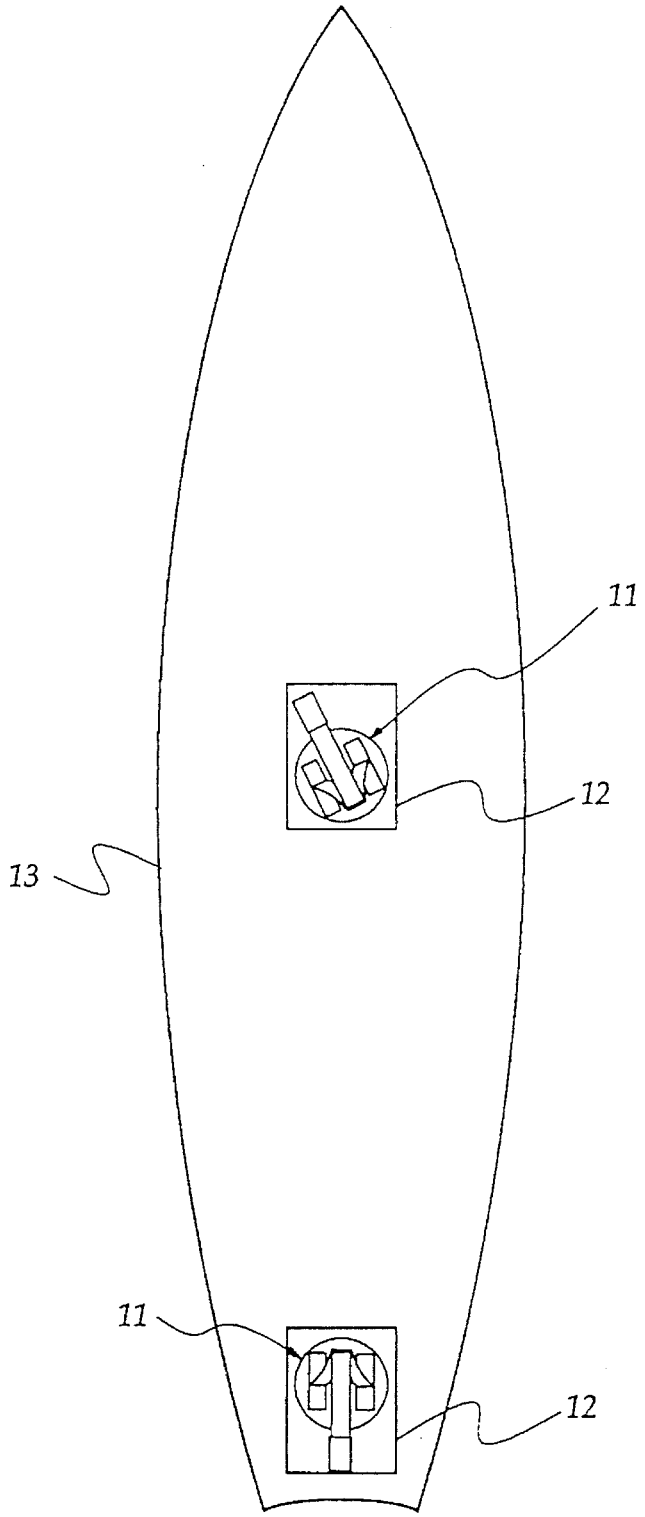
FIG 1 illustrates a surfboard with a pair of retention assemblies attached thereto.

FIG. 1 illustrates a surfboard 13 having a pair of velcro-like patches 12 adhesively bonded to the upper surface proximate the tail and central "sweet spot" of the surfboard. A pair of foot retainers 11 having velcro-like undersurfaces (not shown in FIG. 1 but seen as 27 in FIG. 8) are shown fixed to surfboard 13 for use by a rider. The forward foot retainer can be angled to the right rather than the left as shown for use by a rider leading with the other foot.

Figure 2:
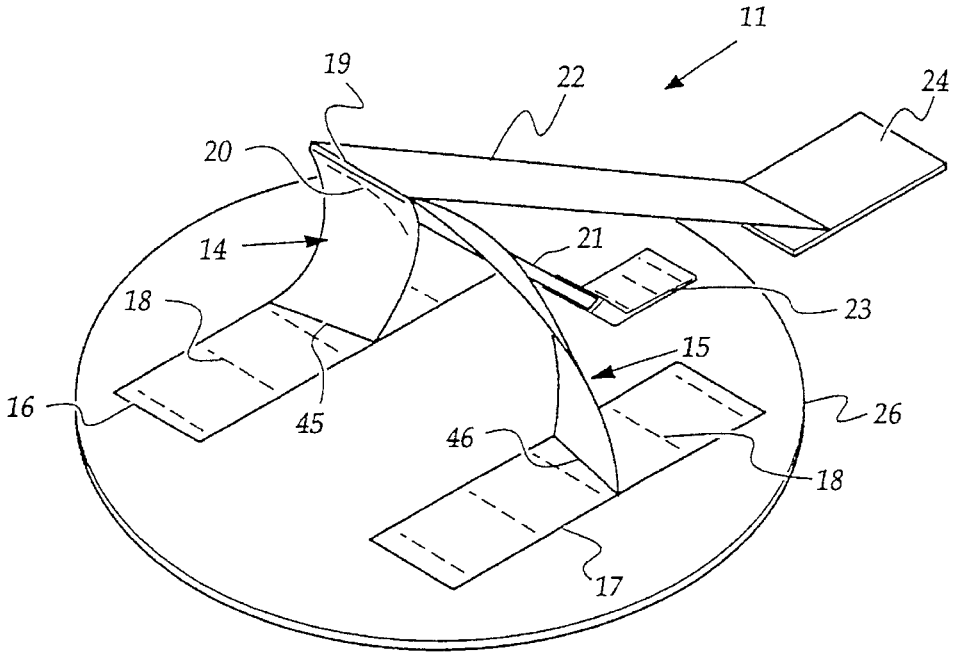
FIGS. 2 and 3 are perspective views of one preferred embodiment of a retention assembly in accordance with the invention.
Figure 3:
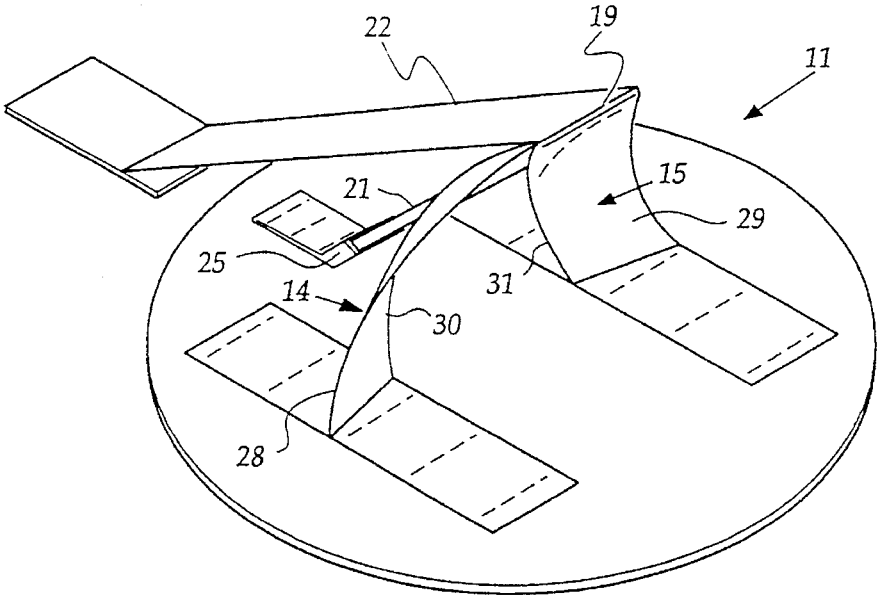
Figure 8:
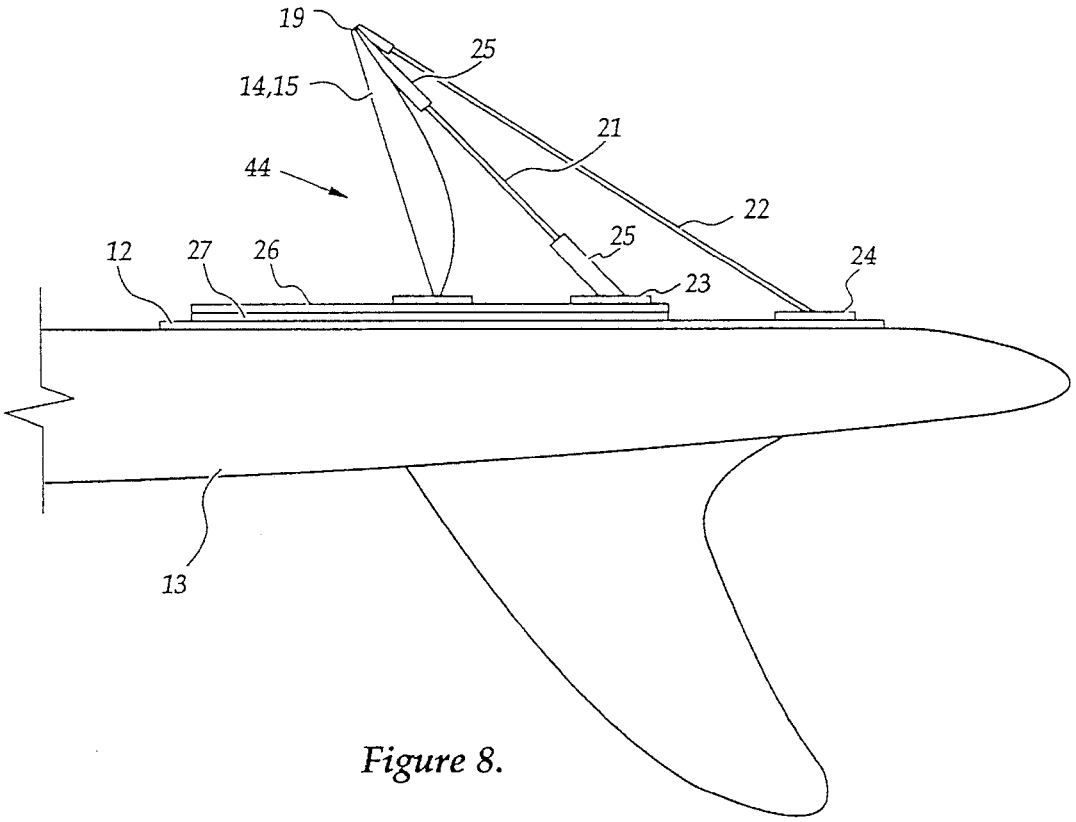
FIG. 8 is a side view of a retention assembly in upstanding attitude attached to the tail of a surfboard.
Figure 9:
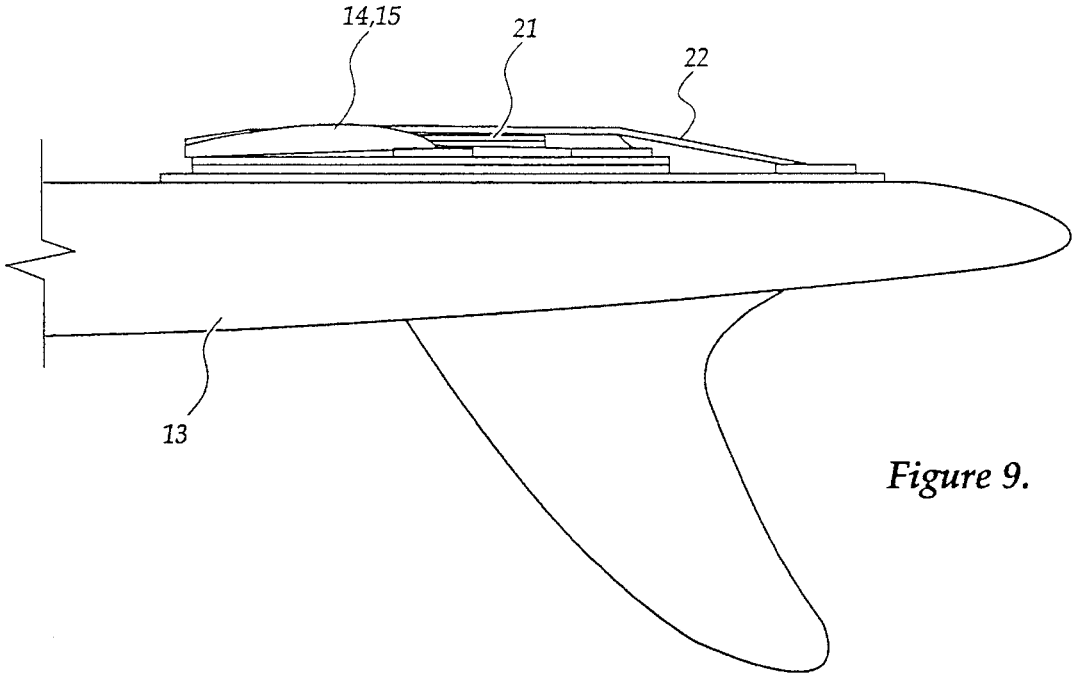
FIG. 9 is a side view of a retention assembly in collapsed attitude attached to the tail of a surfboard.

Foot retainer 11 illustrated in FIGS. 2 and 3 has a pair of flexible PVC straps 14 and 15 joined at their upper ends by stitching 20 to form headpiece 19. Straps 14 and 15 are extensions of base support straps 16 and 17 which are attached to flexible base 26 by stitchings 18. Strut-like batten 21 is connected to headpiece 19 and base 26. As is best seen in FIG. 8, a pair of boots 25 are respectively attached to headpiece 19 and lower connector 23. Connector 23 is attached to base 26 by stitching. Headpiece 19 can thus rotate relative to connector 23 between a prone position seen in FIG. 9 and an upstanding position seen in FIG. 8. The retention assembly is biased to its upstanding position by an elasticised tensioner 22 fixed by stitching to headpiece 19 and to a velcro-like tab 24. Tab 24 is selectively positionable on velcro-like patch 12 to provide variable tensioning.

The outer edges 28 and 29 of straps 14 and 15 are slightly shorter than corresponding inner edges 30 and 31, and the connections 45 and 46 of straps 14 and 15 to base 26 are at a slight angle to the transverse of base support straps 16 and 17. As can be seen in FIG. 8, base 26 is glued or chemically bonded to the back face of a velcro-like surface 27 which can be fixed to velcro-like surface 12 bonded to surfboard 13.

Figure 10:
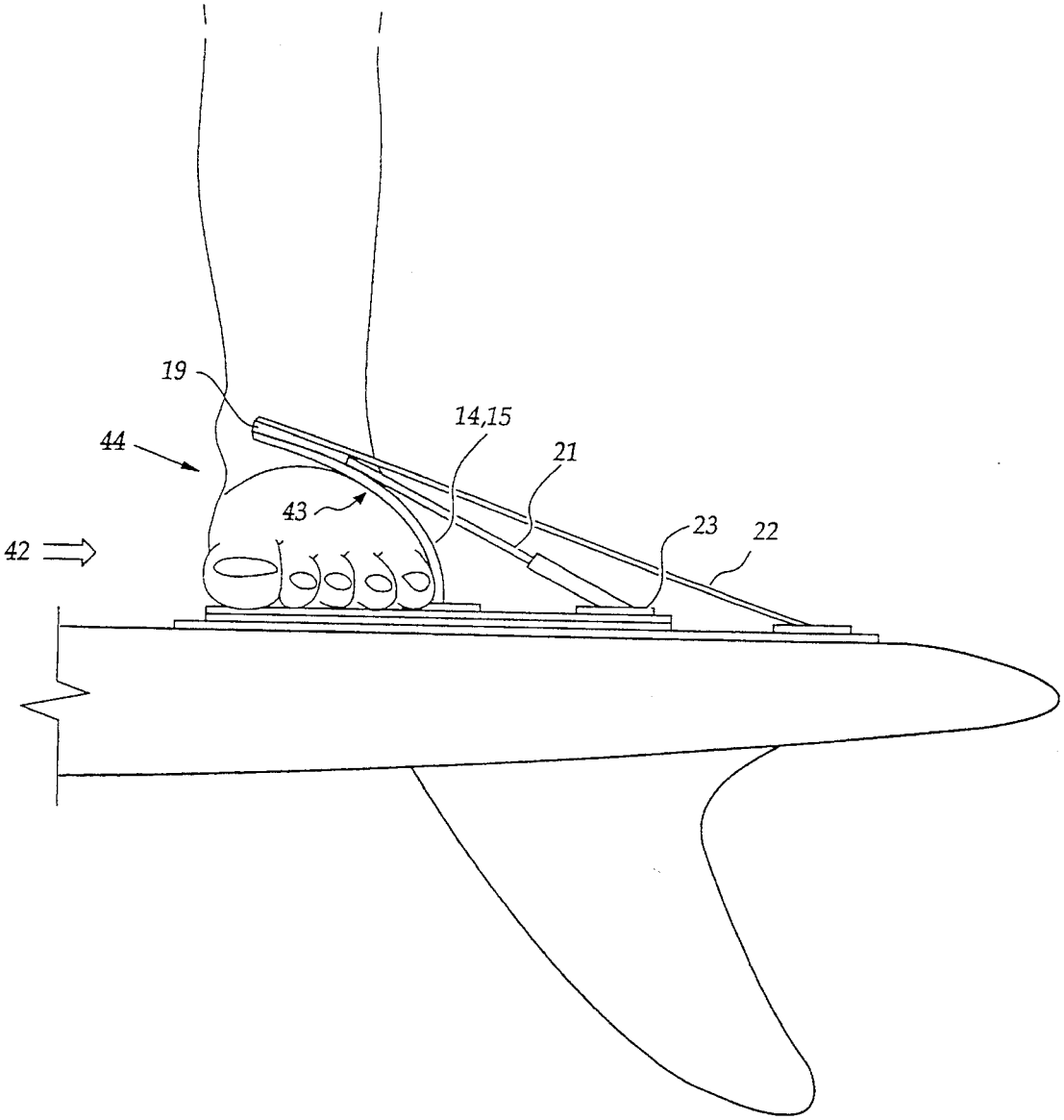
FIG. 10 is a side view of a retention assembly showing the retaining action of the assembly on a user's foot.

It will be seen that in an upstanding attitude batten 21 is inclined upwardly at an acute angle to base 26 to form a jaw 44 into which straps 14 and 15 can move under the sideways action of a rider's foot. As seen in FIG. 10, sideways movement of foot 47 in the direction of arrow 42 against straps 14 and 15 causes headpiece 19 to pivot about connector 23 and move downward to partially envelop the upper area 43 of the foot which is thus retained by the assembly.

Figure 4:
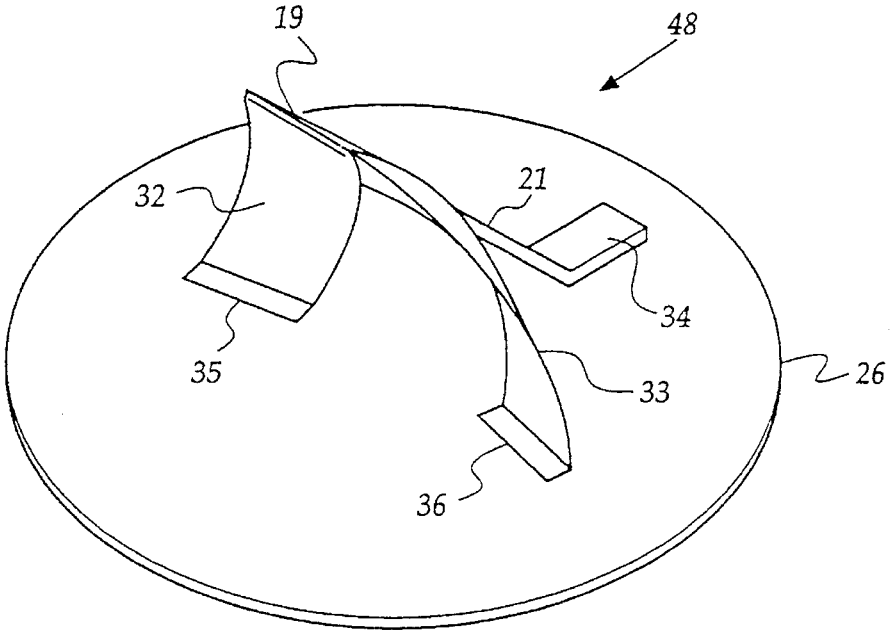
FIGS. 4,5 and 6,7 are perspective views of other preferred embodiments of retention assemblies in accordance with the invention.
Figure 5:
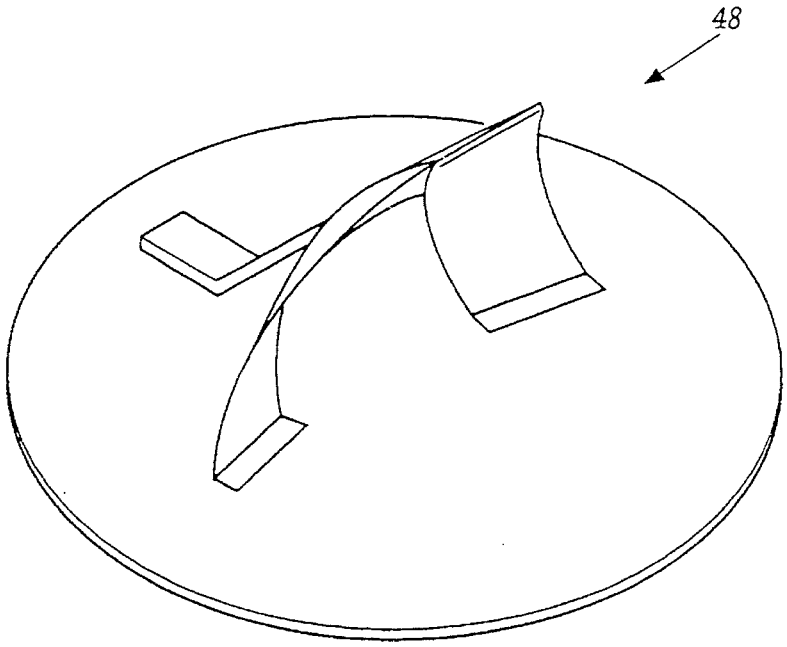

FIGS. 4 and 5 illustrate an alternative embodiment in which straps 32 and 33 and batten 21 of foot retainer 48 are heat welded, ultrasonically welded or otherwise bonded to base 26 at lower ends 35, 36 and 34 respectively. Straps 32 and 33 and batten 21 are bonded together at headpiece 19. The lower end 34 of batten 21 is bent such that the batten resiliently biases headpiece 19 to an upright attitude, thus simulating the function of elasticised tensioner 22.

Figure 6:
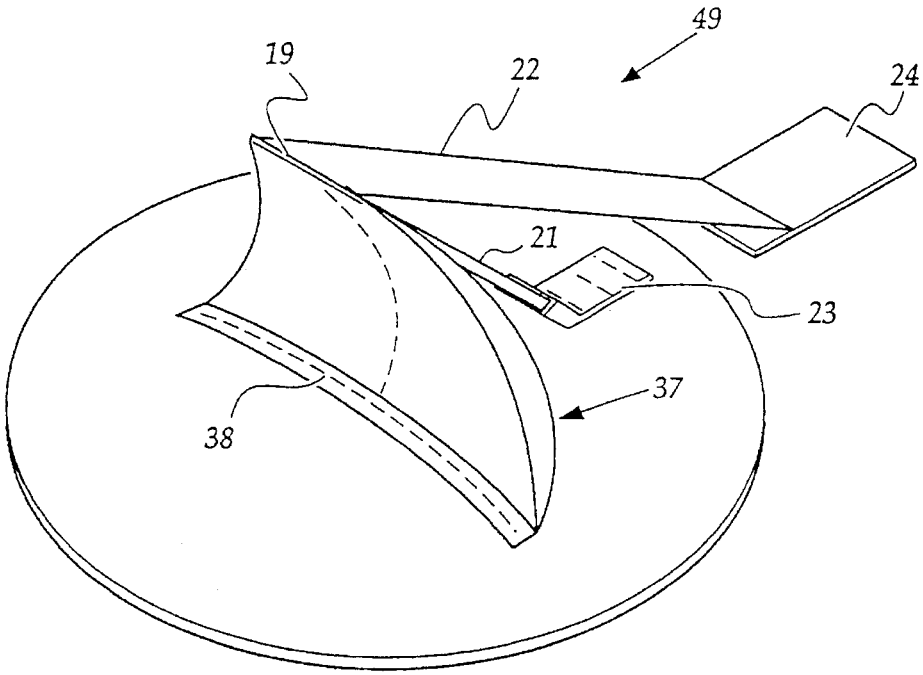
Figure 7:
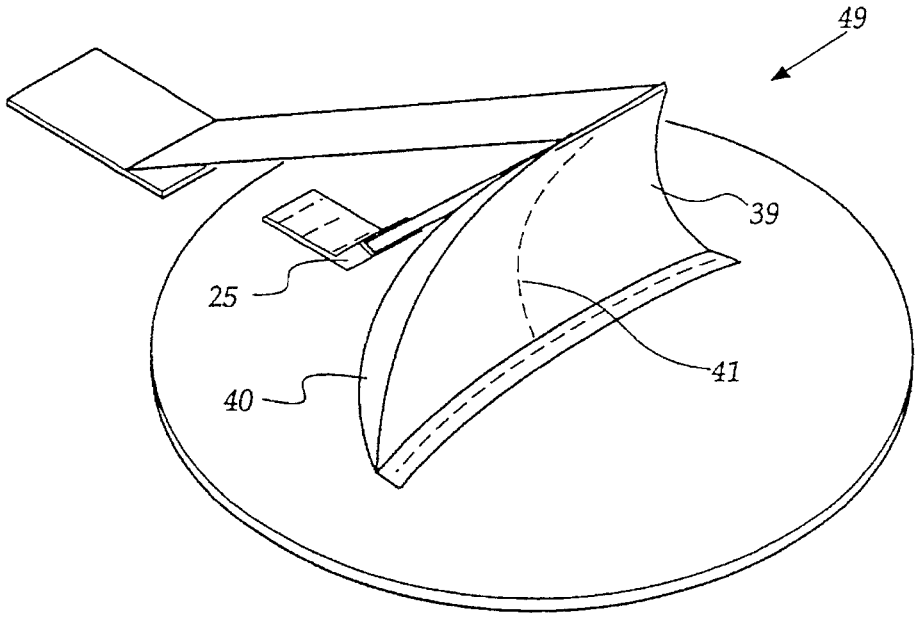

FIGS. 6 and 7 illustrate another preferred embodiment in which the previously described straps are replaced in foot retainer 49 by a piece of flexible PVC sheeting 37 attached to base 26 by stitching 38. Alternatively attachment could be by welding or other bonding. Batten 21 and elasticised tensioner 22 function as described above. The attachment 38 is slightly curved and outer edges 39 and 40 are slightly shorter than back length 41 to provide a cup shape for receiving a rider's foot therein.

It will be realised that the materials referred to in the preferred embodiments described above are merely exemplary of many suitable materials which can be utilised in performing the invention.

In use, velcro-like patches 12 are permanently affixed to the board in the most appropriate central and tail locations and the retention assemblies attached thereto by the velcro-like undersurfaces 27 in locations most preferred by the rider. The collapsible nature of the retention assembly means that rearward movement of the lead foot and forward movement of the tail foot is not impeded, and that a rider can lie prone on the board when swimming.

The retention assembly in accordance with the invention will be seen to have a number of advantages over known retention assemblies. It is collapsible; its location on the board can be easily changed to suit changing surf conditions; retention can be easily disengaged because the assembly releases the rider's foot as the rider removes sideways pressure from the assembly; safety is increased because the rider's foot is not locked in position; heel to toe transitional control is improved because pressure applied to either strap or either edge of the assembly is effective to lower the assembly to retain the foot; directional stability is improved; control of the board is enhanced during aerials, and back leg chaffing caused by fixed blocks is substantially overcome.

Furthermore, the assembly is particularly useful when learning to surf or for coaching and training because the assembly can be selectively positioned to show trainees where the feet should be placed without substantially impeding foot movement across the board.

The retention assembly in accordance with the invention thus allows greater control of a surfboard whilst on the wave face and in aerial manoeuvres above the waves without limiting foot placement and movement.

It will of course be realised that whilst the above has been given by way of an illustrative example of this invention, all such and other modifications and variations hereto, as would be apparent to persons skilled in the art, are deemed to fall within the broad scope and ambit of this invention as is hereinafter claimed.

I claim:

1. A retention assembly for retaining a user's foot in engagement with a support surface to which the retention assembly is attached, said retention assembly including:

foot engagement means having a lower portion flexibly attached to said support surface for engagement by the side of a user's foot;

a distal upper portion for moving over a user's foot when force is applied to said lower portion by the user's foot whereby said foot engagement means abuts the upper areas of a user's foot when a substantially lateral force is applied to said lower portion by the user's foot; and holding means for holding said distal upper portion in an upstanding attitude.

2. A retention assembly as claimed in claim 1, wherein said lower portion includes a plurality of spaced flexible strap-like members, the distal ends of said strap-like members being interconnected and constituting said upper portion.

3. A retention assembly as claimed in claims 2, further including bracing means for rigidly bracing said upper portion for pivotal movement relative to said support surface.

4. A retention assembly as claimed in claim 3, wherein said bracing means is a strut-like member.

5. A retention assembly as claimed in claim 4, wherein said strut-like member is attached to said upper portion and pivotally attached to the assembly at a location distant from the attachments of said strap-like members.

6. A retention assembly as claimed in claim 5, wherein in use the assembly can adopt a prone attitude in which the assembly is substantially flattened against the surface of said support surface or said upstanding attitude in which said foot engagement means projects above said surface.

7. A retention assembly for retaining a user's foot in contact with a support surface, said retention assembly including:

foot engagement means having a lower portion flexibly attached to said support surface for engagement by a user's foot;

a distal upper portion for moving over a user's foot when force is applied to said lower portion by the user's foot whereby said foot engagement means abuts the upper areas of a user's foot when a substantially lateral force is applied to said lower portion by the user's foot; and holding means for holding said distal upper portion in an upstanding attitude;

wherein said lower portion includes a plurality of spaced flexible strap-like members, the distal ends of said strap-like members being interconnected and constituting said upper portion;

further including bracing means for rigidly bracing said upper portion for pivotal movement relative to said support surface wherein said bracing means is a strut-like member;

wherein said strut-like member is attached to said upper portion and pivotally attached to the assembly at a location distant from the attachments of said strap-like members;

wherein in use the assembly can adopt a prone attitude in which the assembly is substantially flattened against the surface of said support surface or said upstanding attitude in which said foot engagement means projects above said surface;

wherein in said upstanding attitude said strut-like member is inclined upwardly at an acute angle to said support surface to form a jaw into which said strap-like members can move under the action of a user's foot thereagainst to pull said upper portion in the direction of said foot.

8. A retention assembly as claimed in claim 7, and including biasing means adapted to bias the assembly from said prone attitude to said upstanding attitude.

9. A retention assembly as claimed in claim 8, wherein said biasing means includes an elastic member connectable to said upper portion and releasably fixable relative to said support surface.

10. A retention assembly as claimed in claim 9, further including attachment means adapted for releasable fixed attachment relative to said support surface.

11. A retention assembly as claimed in claim 10, wherein said attachment means includes at least one releasable engagement means supporting said foot engagement means and releasably engageable by another releasable engagement means fixedly attached to said support surface.

12. A retention assembly as claimed in claim 11, wherein said releasable engagement means comprises velcro-like gripping surfaces, and said foot engagement means and said bracing means are respectively flexibly and pivotally affixed relative to said at least one velcro-like gripping surface.

13. A retention assembly as claims in claim 12, and including a base support fixedly attached to said at least one velcro-like gripping surface; said base support and said foot engagement means being of flexible PVC or similar material, said strut-like member being of hard PVC or similar material, and said foot engagement means and said strut-like member being attached to said base support by at least one of stitching and bonding.

14. A collapsible foot retention assembly, including:

a collapsible member adapted to extend upwardly from a support surface for engagement with a user's foot, said collapsible member including a plurality of spaced flexible strap-like members attached to said support surface, the distal ends of said strap-like members being interconnected; and holding means for holding maid collapsible member in an upstanding attitude, said holding means including a strut-like member;

further including biasing means for biasing said collapsible member to said upstanding attitude;

wherein said strut-like member is attached to said interconnected distal ends and pivotally attached to the assembly at a location distant the attachments of said strap-like members;

wherein in said upstanding attitude said strut-like member is inclined upwardly at an acute angle to said support surface to form a jaw into which said strap-like members can move under the action of a user's foot thereagainst to pull said interconnected distal ends in the direction of said foot.

15. A collapsible foot retention assembly as claimed in claim 14, further including a base support fixedly attached to a velcro-like gripping surface; said base support and said strap-like members being of flexible PVC or similar material, said strut-like member being of hard PVC or similar material, and said foot engagement means and said strut-like member being attached to said base support by at least one of stitching and bonding.

16. A collapsible foot retention assembly, comprising:

a collapsible member adapted to extend upwardly from a support surface and forming a jaw therewith adapted to receive and retain a user's foot; and holding means for holding said collapsible member in an upstanding attitude;

wherein said holding means includes a strut-like member and biasing means adapted to bias said collapsible member to said upstanding attitude; and wherein said collapsible foot retention assembly includes a plurality of flexible strap-like members adapted for spaced attachment relative to said support surface, the distal ends of said strap-like members being interconnected.

17. A collapsible foot retention assembly for retaining a user's foot in engagement with a support surface to which the retention assembly is attached, said retention assembly including:

a collapsible member adapted to extend upwardly from a support surface for engagement with the side of a user's foot, said collapsible member including a plurality of spaced flexible strap-like members attached to said support surface, the distal ends of said strap-like members being interconnected; and holding means for holding said collapsible member in an upstanding attitude, said holding means including a strut-like member;

further comprising means for moving said distal ends of said strap-like members over a user's foot upon application of force to a lower portion of said strap-like members.

* * * * *